US011180168B2

(12) United States Patent
Hubmann et al.

(10) Patent No.: US 11,180,168 B2
(45) Date of Patent: Nov. 23, 2021

(54) CHASSIS FRAME WITH DRIVE UNIT

(71) Applicant: Siemens AG Oesterreich, Vienna (AT)

(72) Inventors: Markus Hubmann, Brodingberg (AT); Christian Karner, Ilz (AT); David Kreuzweger, Graz (AT); Christian Plankensteiner, Doelsach (AT); Michael Sumnitsch, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 743 days.

(21) Appl. No.: 15/507,784

(22) PCT Filed: Aug. 12, 2015

(86) PCT No.: PCT/EP2015/068533

§ 371 (c)(1),
(2) Date: Mar. 1, 2017

(87) PCT Pub. No.: WO2016/045865

PCT Pub. Date: Mar. 31, 2016

(65) Prior Publication Data

US 2017/0282939 A1 Oct. 5, 2017

(30) Foreign Application Priority Data

Sep. 22, 2014 (AT) ..... A 50664/2014

(51) Int. Cl.
*B61F 3/04* (2006.01)
*B61F 5/28* (2006.01)
(Continued)

(52) U.S. Cl.
CPC ..... *B61F 3/04* (2013.01); *B61F 5/28* (2013.01); *B61C 9/50* (2013.01); *B61F 5/26* (2013.01)

(58) Field of Classification Search
CPC ..... B61F 5/50; B61F 5/28; B61F 5/26; B61F 3/04; B62D 21/02; B61C 9/50
See application file for complete search history.

(56) References Cited

U.S. PATENT DOCUMENTS 2,633,203 A * 3/1953 Paton ..... B60G 11/23 180/12
3,817,188 A * 6/1974 Lich ..... B61F 3/04 105/199.3

(Continued)

FOREIGN PATENT DOCUMENTS

CN 101062687 10/2007
CN 201424023 Y 3/2010

(Continued)

OTHER PUBLICATIONS

Office Action dated Apr. 28, 2018 which issued in the corresponding Chinese Patent Application No. 201580051208.9.

*Primary Examiner* — Scott A Browne
(74) *Attorney, Agent, or Firm* — Cozen O'Connor

(57) ABSTRACT

A chassis frame for a rail vehicle which includes at least one drive unit fastened to the chassis frame via at least one elongated fastener, wherein the at least one fastener is arranged transversely with respect to the direction of travel and protrudes into the chassis frame or is guided through brackets which are fixedly connected to the chassis frame and protrudes into a space above or below the chassis frame in order to reduce the weight for the bearing of the drive unit and to facilitate mounting of the drive unit.

18 Claims, 3 Drawing Sheets

(51) Int. Cl.
*B61C 9/50* (2006.01)
*B61F 5/26* (2006.01)

(56) References Cited

U.S. PATENT DOCUMENTS 4,046,080 A 9/1977 Dieling et al.
6,223,850 B1 * 5/2001 Rajca ..... B60K 5/12 180/312
6,595,311 B2 * 7/2003 Fournier ..... B60K 5/12 180/228
7,108,098 B2 * 9/2006 Reese ..... B62D 21/11 180/291
9,352,758 B2 * 5/2016 Chu ..... B61F 3/04
2001/0052432 A1 * 12/2001 Yoshioka ..... B60K 17/344 180/68.3
2002/0163113 A1 * 11/2002 Seynaeve ..... F16F 7/00 267/140.13
2003/0136602 A1 * 7/2003 Tsuda ..... B62D 49/06 180/312
2010/0300324 A1 * 12/2010 Brandstetter ..... B61F 3/04 105/96.1
2011/0163527 A1 * 7/2011 Hunt ..... B62D 27/065 280/785
2013/0241166 A1 * 9/2013 Paintmayer ..... B60G 7/02 280/124.125
2014/0033947 A1 * 2/2014 Starbatty ..... B61C 9/50 105/133

FOREIGN PATENT DOCUMENTS

CN 201842103 U 5/2011
CN 203372230 U 1/2014
CZ 298520 B6 10/2007
DE 19 24 814 A1 1/1970
DE 29 25 836 A1 11/1980
DE 2925836 A1 * 11/1980 ..... B61C 9/50
DE 199 45 464 A1 4/2000
DE 202008007471 U1 12/2008
EP 0 025 771 A1 3/1981
EP 2 500 226 A1 9/2012
GB 482 278 A 3/1938
WO WO 2009/144319 12/2009
WO WO-2014135416 A1 * 9/2014 ..... B61F 1/06

* cited by examiner

CHASSIS FRAME WITH DRIVE UNIT

CROSS-REFERENCE TO RELATED APPLICATIONS

This is a U.S. national stage of application No. PCT/EP2015/068533 filed 12 Aug. 2015. Priority is claimed on Austrian Application No. A50664/2014 filed 22 Sep. 2014, the content of which is incorporated herein by reference in its entirety.

BACKGROUND OF THE INVENTION

1. Field of the Invention

The invention relates to a chassis frame for a rail vehicle, comprising at least one drive unit, such as a motor, fastened to the chassis frame via at least one elongated fastener applicable to bogie (wheel truck) frames, i.e., inside-frame bogies, where the axle bearings and frame sections are between the wheels/wheel disks, but also in principle to outside-frame bogies and wherein the at least one fastener is generally detachable so that the drive unit can be replaced.

2. Description of the Related Art

Because of the limited space available, the positioning of the interface between the drive, on the one hand, and the chassis/bogie on the other represents a major challenge. In the case of rail vehicles, it may therefore be advisable to position the drive adjacent to the chassis in the longitudinal direction. The drive is fastened to the chassis and transmits various forces (e.g., dead weight, or torque) to the chassis frame.

Thus, for example, the drive can be bolted/screwed to the chassis via a motor bearer fixed to the chassis. This motor bearer is located above the drive and is a solid, heavy component that must be appropriately fastened to the chassis frame. The bolting/screwing to the drive through the motor mounts thereof occurs vertically, i.e., the bolts or screws run vertically in the operating state of the chassis.

Another possibility for fastening the drive motor is to dispose elongated detachable fastening elements on the chassis in the direction of travel, which is easily achievable in the case of a long wheelbase, but is often difficult in the case of a short wheelbase because of the space required for mounting and dismounting the drive motor (space for tightening tool, space for fastening the screws/bolts).

SUMMARY OF THE INVENTION

It is therefore an object of the present invention to provide a chassis frame with a drive unit, where the chassis frame is lighter than a chassis frame with a motor bearer, and which enables the drive unit to be mounted/dismounted even in the case of a short wheelbase.

This and other objects and advantages are achieved in accordance with the invention by a chassis frame comprising a drive unit fastened to the chassis frame via at least one elongated fastener.

In accordance with the invention, the at least one fastener is disposed transversely with respect to the direction of travel and projects into the chassis frame or is guided through mounting brackets fixedly connected to the chassis frame, and projects into the space above or below the chassis frame.

"Transversely with respect to the direction of travel" means that the at least one elongated fastener is disposed transversely with respect to the longitudinal extent of the chassis frame, i.e., at right angles to the longitudinal direction of the longitudinal members of the chassis frame, for example. The at least one elongated fastener will generally lie normal to the direction of travel in a horizontal plane in the operating state of the chassis frame.

In general, all the fasteners of a drive unit will inventively project into the chassis frame or into the space above or below the chassis frame.

By enabling fasteners to be fastened directly to the chassis frame or above or below the chassis frame to a mounting bracket rigidly connected thereto by disposing them transversely with respect to the direction of travel, a motor bearer can be dispensed with, thereby providing a weight saving and simplifying the design of the chassis frame.

Connecting the drive unit laterally to the chassis frame provides more available space above the drive unit for the car body.

In addition, the fact that the fasteners extend transversely with respect to the direction of travel ensures that they can be mounted and dismounted even in the case of a short wheelbase.

In particular, it can be provided that at least one fastener is disposed so as to penetrate the chassis frame, in general the longitudinal member, i.e., the entire box girder (both sidewalls), for example, or the web of the longitudinal member in the case of an I-beam as the longitudinal member.

Alternatively, the at least one fastener can penetrate only one sidewall of the longitudinal member (e.g., in the case of a box section as longitudinal member), but not the other sidewall.

If the height of the drive unit in the mounted state exceeds the height of the chassis frame, it may be advisable to provide at least one mounting bracket on the chassis frame, such as on a longitudinal member, where the mounting bracket is penetrated by a fastener. This bracket can be a flat plate, for example. In the operating state of the chassis frame, it is generally disposed vertically (i.e., normal to a chassis frame plane that is spanned by longitudinal and transverse members) and could be implemented, e.g., as an extension of the outer sidewall of the longitudinal member upwards above the longitudinal member.

In particular, but not only, by using brackets above and below the longitudinal member, all the fasteners disposed transversely with respect to the direction of travel are guided through brackets and project into the space above or below the chassis frame. In this case, the mounting of the drive unit is only above and below the longitudinal member and there is no penetration of the longitudinal member itself.

The fastener can basically be used to mount the drive unit to the chassis frame rigidly or via at least one elastic element. The advantage of the at least one elastic element is that the drive unit and chassis frame are decoupled from one another with respect to noise transmission and acceleration. The elastic elements act in conjunction with the fastener.

In general, the elastic element is fixedly connected to the drive unit, because the drive unit is easier to manipulate than the chassis frame.

However, the elastic element is alternatively fixedly connected to the chassis frame.

For both embodiments it is possible for the elastic element to be part of an inner bushing that is fixedly connected either to the chassis frame or to the drive unit and the respective other part (drive unit or chassis frame) is retained in the inner bushing using the elongated fastener. This embodiment of the elastic element is particularly suitable for a drive unit that is aligned transversely with respect to the direction of travel, and is therefore in general disposed between the two longitudinal members.

In principle, it would also be possible to use no elastic elements, but the decoupling effect would then be lost.

Bolts, e.g., together with a mating element, or screws can be provided as fasteners for all the embodiments. Both fasteners have the advantage of being detachable.

In the case of a bolt, this can be pressed into the other part so that the inserted bolt fulfills an emergency arresting function if the mating element fails.

In general, at least two or even four fasteners can be provided for each drive unit depending on the size thereof.

In an embodiment of the invention, the drive unit is disposed in the direction of travel, i.e., laterally outside the longitudinal member.

In another embodiment of the invention, the drive unit is disposed between the longitudinal members transversely with respect to the direction of travel.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following part of the description to the accompanying drawings from which further advantageous embodiments, details and developments of the invention will emerge, in which.

DETAILED DESCRIPTION OF THE EXEMPLARY EMBODIMENTS

Figure 1:
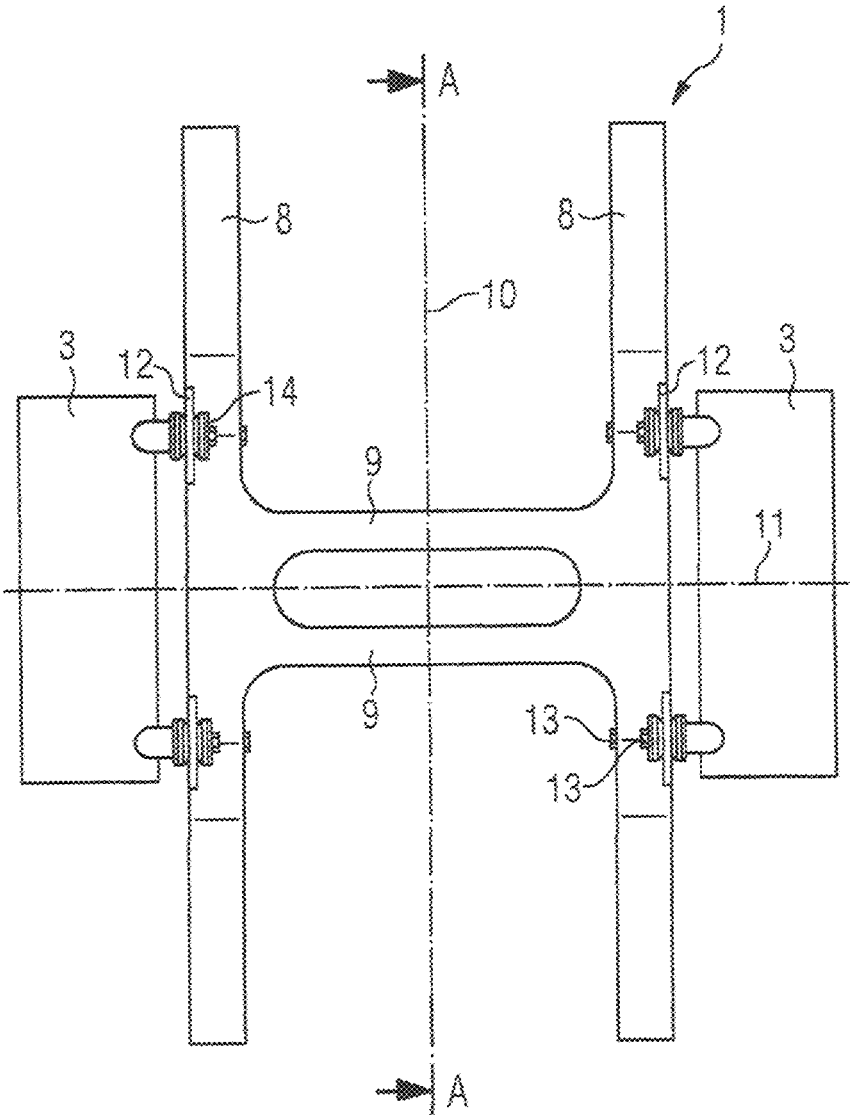
FIG. 1 shows a plan view onto a chassis frame with longitudinally mounted drive unit in accordance with the invention.

FIG. 1 shows a chassis frame 1 consisting of two longitudinal members 8 and two transverse members 9. With respect to the central longitudinal axis 10, which corresponds to the direction of travel, in this example the chassis frame 1 has a symmetrical configuration, likewise with respect to the central transverse axis 11. A motor 3 is fastened to the longitudinal member 8 on either side of the chassis frame 1 outside the respective longitudinal member 8. Each motor 3 is namely fastened to the longitudinal members 8 by four fastening elements in the form of screws 13 (to form a screwed joint with axial motor mounts 14), where the screws 13 extend parallel to the central transverse axis 11, i.e., transversely with respect to the direction of travel. In this configuration of the chassis frame 1, the screws 13 are fastened outside the two transverse members 9, viewed in the longitudinal direction, i.e., in the direction of travel.

If FIG. 1 is conceived of as four perpendicular planes along the outer sides of the chassis frame 1, i.e., along the outer sides and inner sides of the two longitudinal members 8, this defines the space above and below the chassis frame 1 (not shown). Here, four of the screws 13 that are used protrude in this space, or more precisely project into this space above the longitudinal members 8, where four other screws 4 are inserted directly into the two longitudinal members 8.

Figure 2:
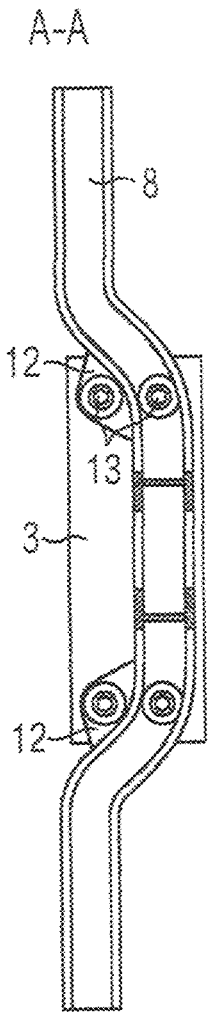
FIG. 2 shows a cross-sectional side view of the chassis frame of FIG. 1.

The fastening of the screws 13 may be seen more clearly in FIG. 2, which shows a section along the A-A axis in FIG. 1. The two lower screws 13 are guided directly through the longitudinal member 8 and retained in the latter, where the longitudinal member 8 is dropped by approximately its height in the central longitudinal area. The two upper screws 13 are guided through mounting brackets 12 fixed to the longitudinal member 8. They can be designed as flat plates that are aligned vertically upward from the longitudinal member, e.g., here as a continuation of the outer sidewall of the longitudinal member 8. Such mounting brackets 12 can be of much smaller dimensions and are therefore much lighter than conventional motor bearers.

Figure 4:
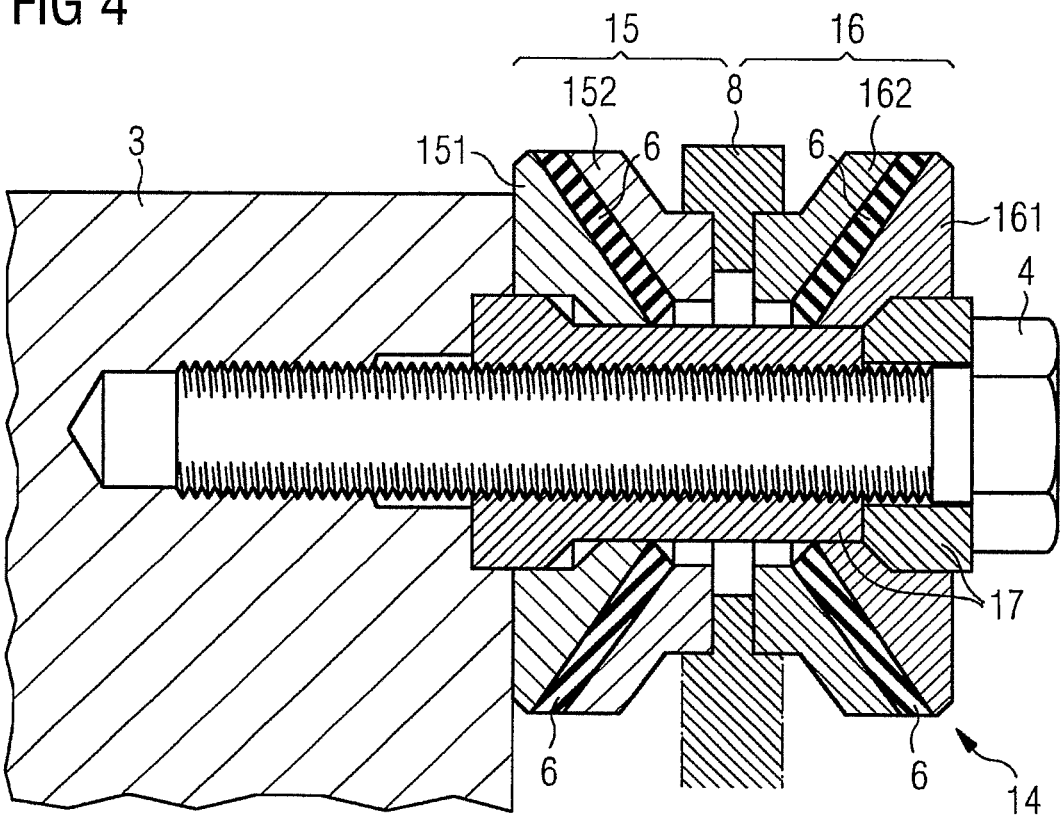
FIG. 4 shows the connection between drive unit and chassis frame of FIG. 1.

On both sides of the mounting bracket 12, i.e., on the inner and outer side of the longitudinal member 8, there is provided for each screw 13 an elastic motor mount 14 that can be implemented as in FIG. 4, for example: it has two metal mount halves 15, 16, where the first mount half 15 is disposed on the outside of the longitudinal member 8 or rather of the mounting bracket 12, i.e., on the motor 3, and where the second mount half 16 on the inside of the longitudinal member 8 or rather of the mounting bracket 12. In the region of the motor mount 14, the screw 13 is surrounded by a spacer sleeve 17 against which the mount halves 15, 16 rest. Each mount half 15, 16 can, as shown here, be of a two-part configuration, where there is then provided between the two parts 151, 152; 161, 162 an elastic element 6, e.g., a flat rubber layer, which overlies the two parts 151, 152; 161, 162 in a planar manner. The inner part 151 of the first mount half 15 and the inner part 161 of the second mount half 16 are firmly clamped to the motor 3 by screw 13 and spacer sleeve 17. The outer part 152 of the first mount half 15 and the outer part 162 of the second mount half 16 are tensioned against the chassis frame 1, i.e., here the longitudinal member 8 (or more precisely the mounting bracket 12), where the force is transmitted via the elastic element 6. As a result, a sight displacement in the elastic element 6 is possible.

Self-evidently, the motor mount 14 could also be of reverse design, i.e. the inner parts 151, 161 of the two mount halves 15, 16 as well as the screw 13 and the spacer sleeve 17 are fixedly connected to the chassis frame 1 (the longitudinal member 8 or rather the mounting bracket 12), while the outer parts 152, 162 are fixedly connected to the motor 3.

The motor mount 14 could also be implemented without elastic elements 6 if elastic support of the motor 3 on the chassis frame 1 is not required. The mount halves 15, 16 would then have a one-part design, where the parts 151 and 152, on the one hand, and parts 161 and 162, on the other, could therefore each be combined into one piece.

In the embodiments depicted in FIGS. 1-4, the drive unit 3 is disposed in the direction of travel, where the longitudinal axis or longitudinal extent of the motor 3 is parallel to the direction of travel or central longitudinal axis 10 of the chassis frame. The drive unit 3 is disposed laterally outside each longitudinal member 8. The motor 3 pulls or pushes in the axial direction of the screws 13.

In the case of a longitudinal arrangement of the motor 3, the elongated fastener have hitherto generally been disposed vertically, i.e., normal to the central longitudinal and transverse axis 10, 11.

Figure 3:
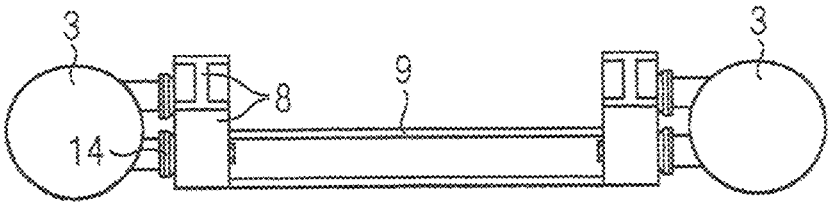
FIG. 3 shows a front view of the chassis frame of FIG. 1.

As shown in FIG. 3, the motors 3 are disposed approximately within the vertical extent of the longitudinal member 8 (from the bottom edge of the dropped section to the top edge of the straight sections) and do not extend significantly beyond this region.

Figure 5:
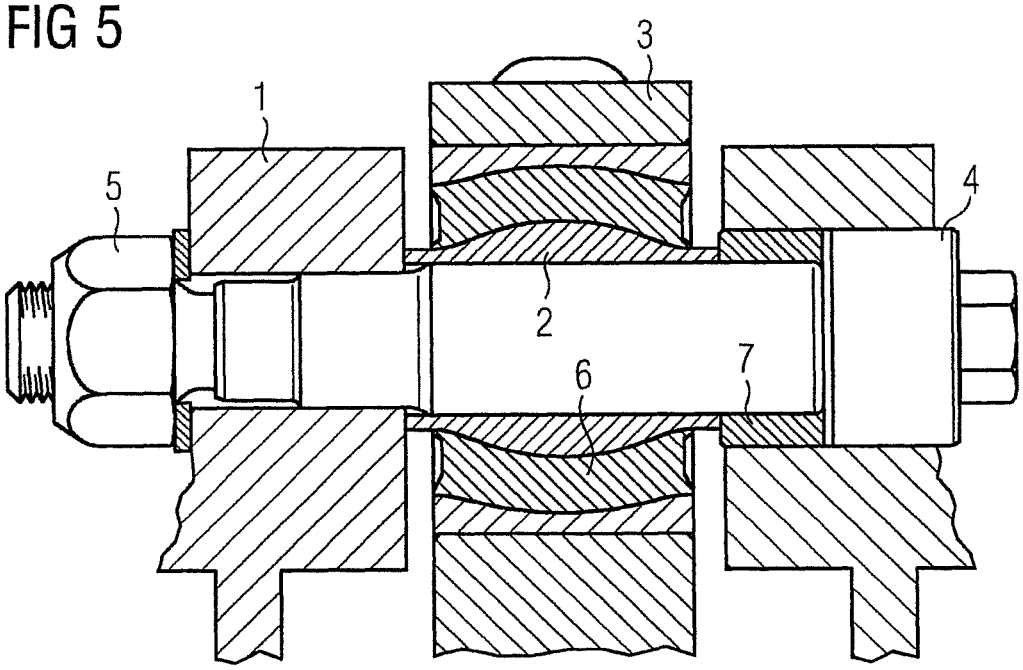
FIG. 5 shows an inner bushing disposed on a motor for transversely mounted drive units in accordance with the invention.

FIG. 5 shows a possible embodiment in which the connection between the motor 3 and chassis frame 1 is via an elastic element 6. For this purpose, the motor 3 is provided with a bushing into which a metal-rubber element is pressed as an inner bushing 2, said metal-rubber element having at least one sleeve-like elastic rubber layer 6. The latter has a larger diameter in the center than at the edge.

The bolt 4 is inserted through the chassis frame 1 on both sides of the bushing of the motor 3. With a mating element 5 implemented as a nut (a screw would also be possible) at the head of the bolt, the bolt 4 tensions the inner bushing 2 against the chassis frame 1 and therefore transmits the transverse forces.

The bolt 4 can be surrounded by an intermediate bushing 7 at the end of the shank where it is supported in the chassis frame 1, which serves to facilitate mounting. The longitudinal and vertical forces are transmitted via the mountings on the head and shank of the bolt 4.

Figure 6:
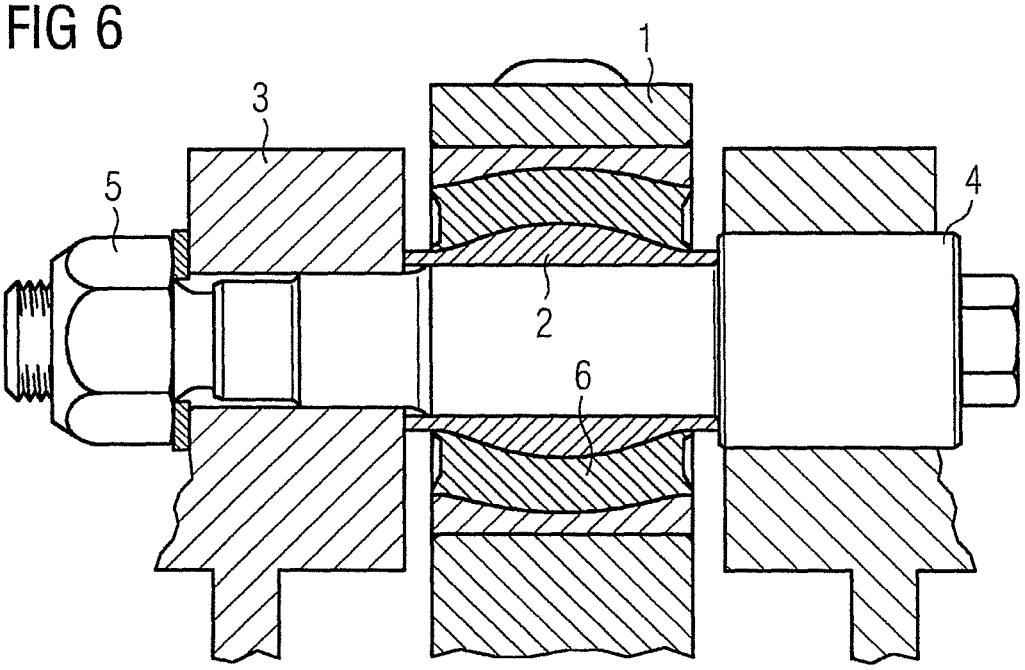
FIG. 6 shows an inner bushing disposed on the chassis frame for transversely mounted drive units in accordance with the invention.

As the reverse of FIG. 5, FIG. 6 shows a bushing that is disposed on the chassis frame 1 and into which a metal-rubber element is pressed as an inner bushing 2, said metal-rubber element having at least one sleeve-like layer of rubber 6. The bolt 4 is inserted through the motor 3 on both sides of the bushing. With a mating element 5 implemented as a nut (a screw would also be possible here instead) at the head of the bolt 4, the bolt 4 tensions the inner bushing 2 against the motor 3 and therefore transmits the transverse forces. The longitudinal and vertical forces are again transmitted via the mountings on the head and shank of the bolt 4.

These embodiments of the elastic element depicted in FIGS. 5 and 6 are particularly suitable for a drive unit oriented transversely with respect to the direction of travel (i.e., with the longitudinal extent or longitudinal axis of the drive unit 3 parallel with the central transverse axis 11), therefore generally disposed between the two longitudinal members 8. The axes of the bolts 4 or rather mating elements 5 are aligned parallel to the longitudinal axis of the motor 3, and can be disposed alongside (level with) the motor 3, but also above or below the motor 3 in the operating position of the chassis frame 1.

Transversely mounted motors 3 have hitherto mostly been screwed/bolted to the chassis frame in the direction of travel (parallel to the central longitudinal axis 10) or vertically (normal to the central longitudinal axis 10 and to the central transverse axis 11), whereas a connection by bolts 4 and mating elements 5 in the transverse direction is now proposed.

However, the type of connection by bolts 4 and mating elements 5 as shown in FIGS. 5 and 6 can basically also be used for other arrangements of the motor 3, where the axis of the bolt 4 or rather of the mating element 5 then no longer runs transversely with respect to the direction of travel. Thus, in the case of a longitudinal arrangement of the motor 3 (as in FIG. 1), the axis of the bolt 4 could likewise extend in the longitudinal direction (parallel to the central longitudinal axis 10). In this arrangement, the motor 3 would pull or push transversely with respect to the axial direction of the bolt 4.

In all the embodiments shown, the bolts 4 and screws 13 are dismountable and extend horizontally and normal to the direction of travel in the operating position of the chassis frame 1.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis frame for a rail vehicle, comprising:

at least one motor fastened to the chassis frame by at least one elongated fastener of elongated fasteners disposed transversely with respect to a direction of travel of the chassis frame;

transverse members extending between the elongated fasteners; and mounting brackets fixedly connected to the chassis frame on top and at an outer longitudinally extending edge of the chassis frame;

wherein said at least one elongated fastener is guided through at least one mounting bracket of the mounting brackets which is fixedly connected to the chassis frame, and projects into a space located above;

wherein the at least one elongated fastener comprises a screw which extends horizontally and in parallel to a central transverse axis of the chassis frame;

wherein the chassis frame is defined by two longitudinal members extending from a region of the chassis frame which includes the transverse members in a forward and rearward direction with respect to the direction of travel of the chassis frame;

wherein the chassis frame supports the at least one motor with two configurations, each configuration being dependent on an orientation of the at least one motor, a first configuration of the two configurations having the at least one motor extending across a transverse center line of the chassis frame and a second configuration of the two configurations having the motor extending across a longitudinal center line of the chassis frame;

wherein the transverse members form part of the chassis frame and interconnect the two longitudinal members; and wherein the two longitudinal members form a portion of the chassis frame to which the mounting brackets are fixedly connected.

2. The chassis frame as claimed in claim 1, wherein another at least elongated one fastener is disposed so as to penetrate one of the longitudinal members of the chassis frame.

3. The chassis frame as claimed in claim 1, wherein another at least elongated one fastener is disposed so as to penetrate a sidewall of one of the longitudinal members of the chassis frame.

4. The chassis frame as claimed in claim 1, wherein the at least one mounting bracket of the mounting brackets is arranged on one of the longitudinal members of the chassis frame.

5. The chassis frame as claimed in claim 2, wherein the at least one mounting bracket of the mounting brackets is arranged on one of the longitudinal members of the chassis frame.

6. The chassis frame as claimed in claim 3, wherein the at least one mounting bracket of the mounting brackets is arranged on one of the longitudinal members of the chassis frame.

7. The chassis frame as claimed in claim 1, wherein the at least one motor is mounted on the chassis frame by at least one elastic element acting in conjunction with the at least one fastener.

8. The chassis frame as claimed in claim 7, wherein the at least one elastic element is fixedly connected to the at least motor.

9. The chassis frame as claimed in claim 7, wherein the at least one elastic element is fixedly connected to the chassis frame.

10. The chassis frame as claimed in claim 7, wherein the at least one elastic element is provided between two parts of a mount half of an elastic motor mount and overlies the two parts of the mount half in a planar manner.

11. The chassis frame as claimed in claim 8, wherein the at least one elastic element is provided between two parts of a mount half of an elastic motor mount and overlies the two parts of the mount half in a planar manner.

12. The chassis frame as claimed in claim 1, wherein the at least one motor is disposed in the direction of travel of the chassis frame.

13. The chassis frame as claimed in claim 1, wherein the at least one motor is disposed laterally outside the at least one longitudinal member.

14. The chassis frame as claimed in claim 1, wherein the at least one motor is disposed transversely with respect to the direction of travel between longitudinal members.

15. The chassis frame as claimed in claim 9, wherein the at least one elastic element is provided between two parts of a mount half of an elastic motor mount and overlies the two parts of the mount half in a planar manner.

16. The chassis frame as claimed in claim 1, wherein the transverse members are spaced apart in the longitudinal direction.

17. A chassis frame for a rail vehicle, comprising:

at least one motor fastened to the chassis frame by at least one elongated fastener of elongated fasteners disposed transversely with respect to a direction of travel of the chassis frame;

transverse members extending between the elongated fasteners; and mounting brackets fixedly connected to the chassis frame on top and at an outer longitudinally extending edge of the chassis frame;

wherein said at least one elongated fastener is guided through at least one mounting bracket of the mounting brackets fixedly connected to the chassis frame, and projects into a space located above; and wherein the at least one elongated fastener comprises a screw which extends horizontally and in parallel to a central transverse axis of the chassis frame;

wherein the at least one elongated fastener includes at least two elongated fasteners extending through different portions of the frame or different ones of the mounting brackets in a manner such that the at least two fasteners extend substantially parallel with each other along the direction of travel or along a transverse axis depending on whether the at least one motor is mounted internally or externally with respect to the chassis frame;

wherein the chassis frame is defined by two longitudinal members extending from a region of the chassis frame which includes the transverse members in a forward and rearward direction with respect to the direction of travel of the chassis frame of the rail vehicle;

wherein the chassis frame supports the at least one motor with two configurations, each configuration being dependent on an orientation of the at least one motor, a first configuration of the two configurations having the at least one motor extending across a transverse center line of the chassis frame and a second configuration of the two configurations having the motor extending across a longitudinal center line of the chassis frame;

wherein the transverse members form part of the chassis frame and interconnect the two longitudinal members; and wherein the two longitudinal members form a portion of the chassis frame to which the mounting brackets are fixedly connected.

18. The chassis frame as claimed in claim 17, wherein the transverse members are spaced apart in the longitudinal direction.

* * * * *